US008509633B2

(12) United States Patent
Inukai

(10) Patent No.: US 8,509,633 B2
(45) Date of Patent: Aug. 13, 2013

(54) HEATING DEVICE AND IMAGE FORMING APPARATUS

(75) Inventor: Katsumi Inukai, Iwakura (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 295 days.

(21) Appl. No.: 12/892,266

(22) Filed: Sep. 28, 2010

(65) Prior Publication Data

US 2011/0123208 A1 May 26, 2011

(30) Foreign Application Priority Data

Nov. 26, 2009 (JP) ..... 2009-269047

(51) Int. Cl.
*G03G 15/20* (2006.01)

(52) U.S. Cl.
USPC ..... 399/37; 399/69; 399/88

(58) Field of Classification Search
USPC ..... 399/37, 69, 88; 219/216
See application file for complete search history.

(56) References Cited

U.S. PATENT DOCUMENTS

| | | | | |
|---|---|---|---|---|
| 7,189,949 | B1 * | 3/2007 | Bush et al. | 219/216 X |
| 7,949,885 | B2 * | 5/2011 | Kikuchi et al. | 399/37 X |

FOREIGN PATENT DOCUMENTS

| | | | |
|---|---|---|---|
| JP | 63-290518 | A | 11/1988 |
| JP | 6-019364 | A | 1/1994 |
| JP | 8-137338 | A | 5/1996 |
| JP | 09-054122 | | 2/1997 |
| JP | 2000-298414 | A | 10/2000 |
| JP | 2002-296955 | A | 10/2002 |
| JP | 2004-013668 | | 1/2004 |
| JP | 2004-077595 | | 3/2004 |
| JP | 2004-139008 | A | 5/2004 |
| JP | 2005-019295 | | 1/2005 |
| JP | 2005-037627 | | 2/2005 |
| JP | 2005-084546 | | 3/2005 |
| JP | 2008-065033 | A | 3/2008 |
| JP | 2009-118010 | A | 5/2009 |

OTHER PUBLICATIONS

Machine translation of JP 06-019364 dated Nov. 1, 2012.*
Machine translation of JP 08-137338 dated Nov. 1, 2012.*
Machine translation of JP 2000-298414 dated Nov. 1, 2012.*
Machine translation of JP 2008-065033 dated Nov. 1, 2012.*
Machine translation of JP 2009-118010 dated Nov. 1, 2012.*
Notification of Reasons for Refusal dispatched Sep. 22, 2011 in Japanese Application No. 2009-269047 and English translation thereof.

(Continued)

*Primary Examiner* — Sophia S Chen
(74) *Attorney, Agent, or Firm* — Banner & Witcoff, Ltd.

(57) ABSTRACT

A heating device includes: a heat generating unit generating heat in response to energization of an alternating-current power supply; a zero-crossing signal generating circuit generating a zero-crossing signal in synchronization with a zero-crossing time of the alternating-current power supply; an energization regulating unit regulating an energization period of the heat generating unit by the alternating-current power supply; a voltage change rate detecting unit detecting whether a rate of voltage change of the alternating-current power supply at the zero-crossing time is equal to or larger than an predetermined value; a switching unit switching on and off a connection between the alternating-current power supply and the heat generating unit; and an energization disabling unit disabling energization of the heat generating unit by controlling the switching unit when the rate of voltage change is equal to or larger than the predetermined value.

12 Claims, 9 Drawing Sheets

(56) References Cited

OTHER PUBLICATIONS

JP Office Action dtd Mar. 27, 2012, JP Appln. 2009-269047, English translation.

CN Office Action mailed Jun. 9, 2013, CN App 201010516382.5, English translation.

* cited by examiner

HEATING DEVICE AND IMAGE FORMING APPARATUS

CROSS REFERENCE TO RELATED APPLICATION

The present application claims priority from Japanese Patent Application No. 2009-269047, which was filed on Nov. 26, 2009, the disclosure of which is herein incorporated by reference in its entirety.

TECHNICAL FIELD

Apparatuses and devices consistent with the present invention relate to a heating device and an image forming apparatus having the heating device, and more specifically, to a technique for coping with abnormalities in the power supply of a heating device.

BACKGROUND

According to one of the related art, a technique for coping with abnormalities in the power supply of a heating device is disclosed. Specifically, the related art discloses a technique of controlling a heating device so as to be independent of the frequencies of a power supply when a zero-crossing signal fluctuates due to an external noise or the like and abnormalities occur in the detected frequencies of the power supply.

SUMMARY

However, although the related art technique allows the heating device to continue its operation even when the zero-crossing signal fluctuates and abnormalities occur in the detected frequencies of the power supply, no disclosure is made regarding a technique for coping with changes in the waveform of the power supply appearing as abnormalities in the power supply. When a rectangular alternating-current voltage rather than a sinusoidal alternating-current voltage is input into the heating device by an uninterruptible power supply unit, for example, the rising/falling edge at the zero-crossing point of the power supply waveform becomes steep. That is, the rate of voltage change (dv/dt) becomes large. Thus, for example, when a TRIAC is used for controlling the energization period of a heater of a heating device, there is a case that it may not be possible to turn off the TRIAC in response to zero-crossing of the power supply if the rate of voltage change (dv/dt) at a zero-crossing point exceeds an allowable characteristic value for a device. In such a case, the heater of the heating device may continue to be energized, thus causing problems in the heating device.

The present invention aims to provide a technique for suppressing the occurrence of problems in the heating device due to the input rectangular wave.

According to an illustrative aspect of the present invention, there is provided a heating device comprising: a heat generating unit that generates heat in response to energization of an alternating-current power supply; a zero-crossing signal generating circuit that generates a zero-crossing signal in synchronization with a zero-crossing time of the alternating-current power supply; an energization regulating unit that regulates an energization period of the heat generating unit by the alternating-current power supply based on the zero-crossing signal; a voltage change rate detecting unit that detects whether or not a rate of voltage change of the alternating-current power supply at the zero-crossing time is equal to or larger than an predetermined value; a switching unit that is provided between the alternating-current power supply and the heat generating unit, the switching unit switching on and off a connection between the alternating-current power supply and the heat generating unit; and an energization disabling unit that disables energization of the heat generating unit by the alternating-current power supply by controlling the switching unit when the rate of voltage change is equal to or larger than the predetermined value.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Embodiment 1

Hereinafter, Embodiment 1 of the present invention will be described with reference to FIGS. 1 to 7.

1. Configuration of Laser Printer

Figure 1:
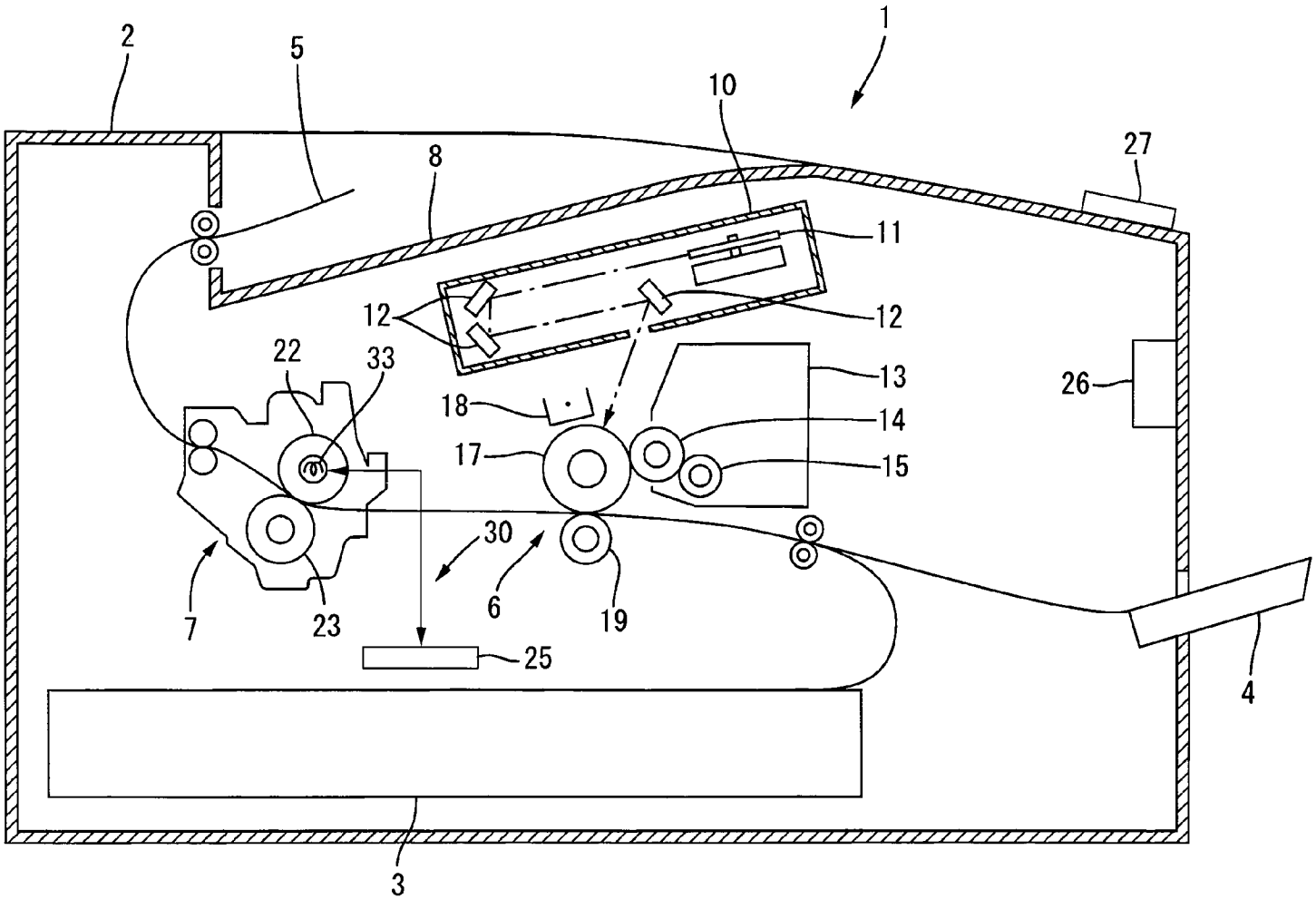
FIG. 1 is a side sectional diagram showing a schematic configuration of an image forming apparatus according to the present invention.

FIG. 1 is a diagram schematically showing a vertical cross-section of a monochrome laser printer 1 (an example of "image forming apparatus") of Embodiment 1. It should be noted that the image forming apparatus is not limited to the monochrome laser printer but may be, for example, a color laser printer, a color LED printer, and a multi-function printer.

In a monochrome laser printer (hereinafter simply referred to as "printer") 1, an image forming unit 6 forms toner images on a sheet 5 which is supplied from a tray 3 or a manual insertion tray 4 positioned in the lower part of a main casing 2. The toner images are subjected to a fixing treatment by being heated by a fixing unit 7, and the sheet 5 is discharged to a discharge tray 8 positioned in the upper part of the main casing 2.

The image forming unit (an example of "image forming unit") 6 includes a scanner unit 10, a developing cartridge 13, a photosensitive drum 17, a charger 18, a transfer roller 19, and the like.

The scanner unit 10 is positioned on the upper part of the main casing 2 and includes a laser emitting portion (not shown), a polygon mirror 11, a plurality of reflecting mirrors 12 and a plurality of lenses (not shown), and the like. In the scanner unit 10, laser light emitted from the laser emitting portion passes through the polygon mirror 11, the reflecting mirrors 12, and the lenses to be irradiated by high-speed scanning onto the surface of the photosensitive drum 17 as shown by a one-dot chain line.

The developing cartridge 13 is detachably attached and configured to contain toner therein. Moreover, in a toner supply port of the developing cartridge 13, a developing roller 14 and a supply roller 15 are provided so as to face each other. Further, the developing roller 14 is disposed so as to face the photosensitive drum 17. The toner in the developing cartridge 13 is supplied to the developing roller 14 by the rotation of the supply roller 15 and carried on the developing roller 14.

The charger 18 is disposed above the photosensitive drum 17 with a spacing therebetween. Moreover, the transfer roller 19 is disposed below the photosensitive drum 17 so as to face the photosensitive drum 17.

When the photosensitive drum 17 rotates, first, the surface of the photosensitive drum 17 is uniformly charged with a positive polarity by the charger 18. Subsequently, electrostatic latent images are formed on the photosensitive drum 17 by the laser light from the scanner unit 10. After that, when the photosensitive drum 17 rotates in contact with the developing roller 14, the toner carried on the developing roller 14 is supplied and carried on the electrostatic latent images on the surface of the photosensitive drum 17. Thus, toner images are formed on the surface of the photosensitive drum 17. Thereafter, the toner images are transferred to the sheet 5 by a transfer bias applied to the transfer roller 19 when the sheet 5 passes through a space between the photosensitive drum 17 and the transfer roller 19.

The fixing unit 7 is disposed downstream from the image forming unit 6 in the sheet transport direction and includes a fixing roller 22, a pressing roller 23 that presses the fixing roller 22, and a halogen heater 33 (an example of the "heat generating unit" of the present invention) that heats the fixing roller 22. The halogen heater 33 is connected to a circuit board 25 and energized in accordance with a signal from the circuit board 25.

The printer 1 includes a photo data importing unit 26 that imports photo data (image data) generated by a digital camera and a display device 27 that displays print information or the like.

2. Electrical Configuration of Heating Device

Figure 2:
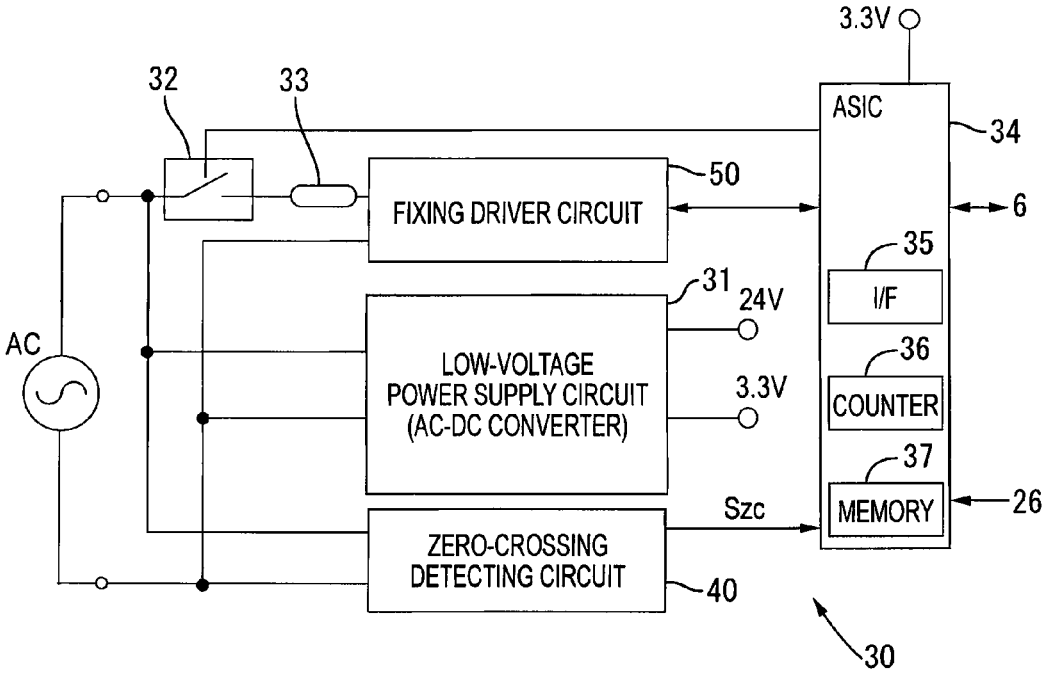
FIG. 2 is a block diagram showing a schematic configuration of a heating device of Embodiment 1.
Figure 3:
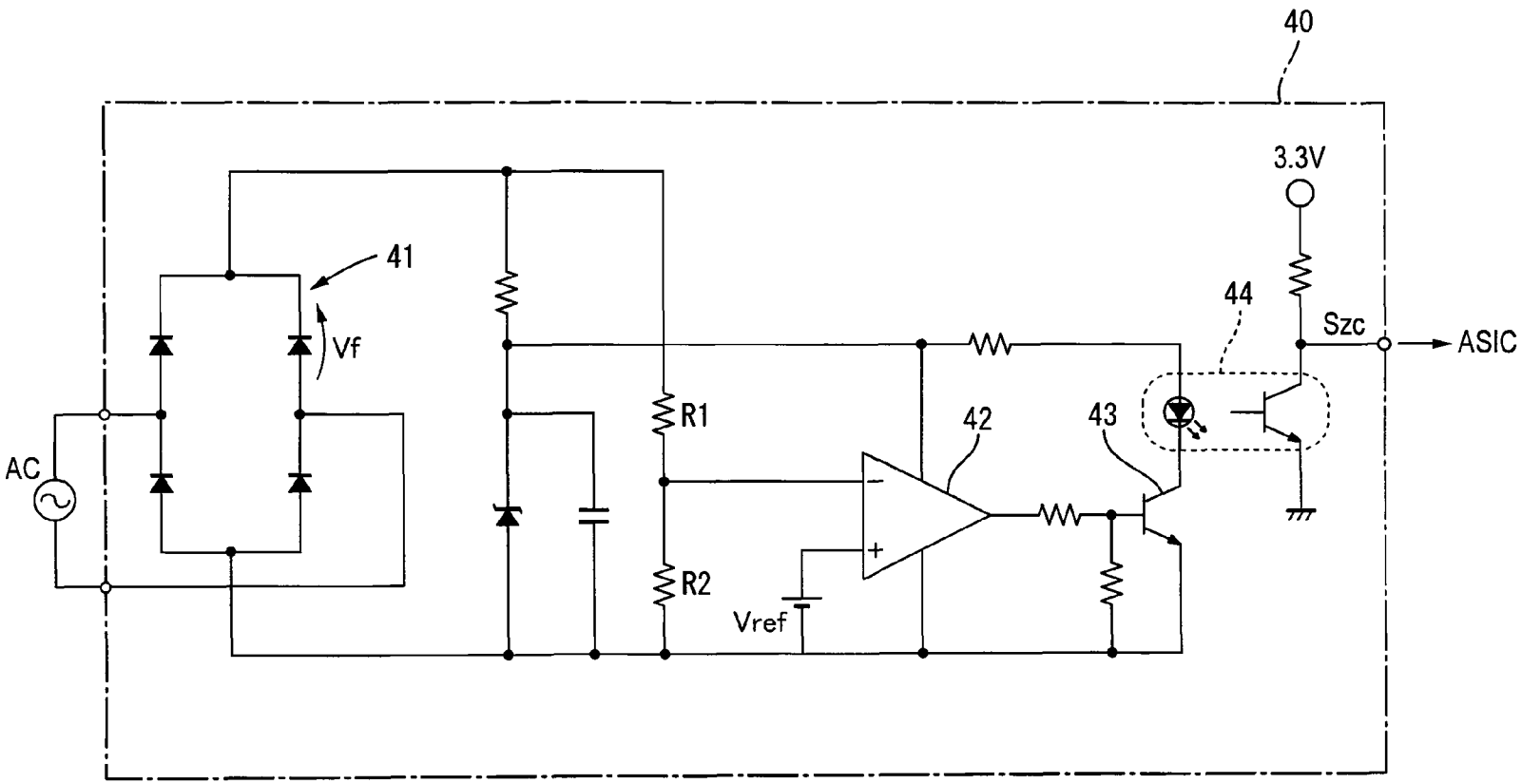
FIG. 3 is a block diagram showing a schematic configuration of a zero-crossing detecting circuit of a heating device.
Figure 4:
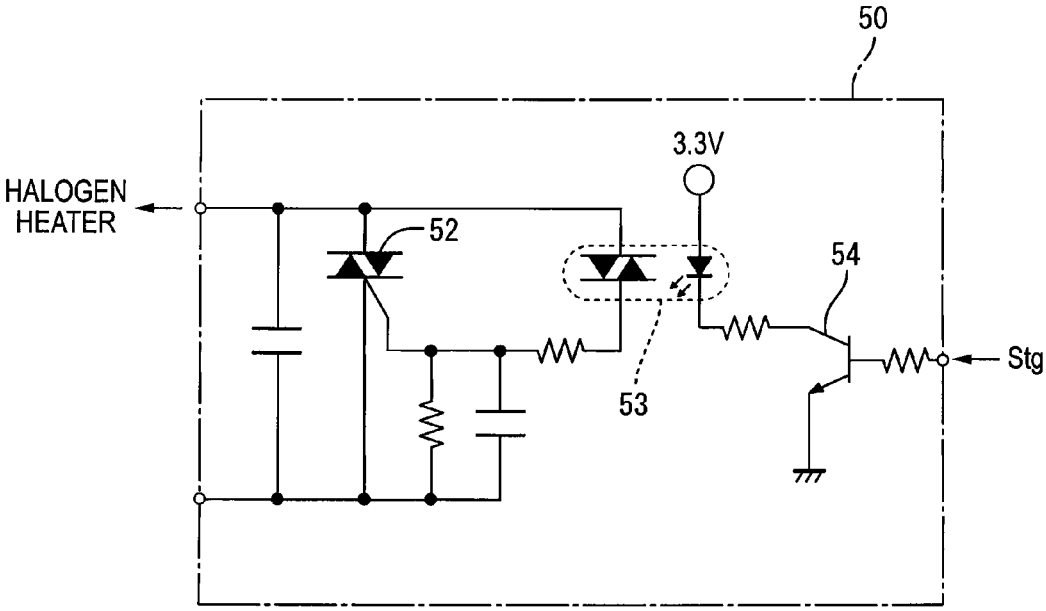
FIG. 4 is a block diagram showing a schematic configuration of a fixing driver circuit of a heating device.
Figure 6:
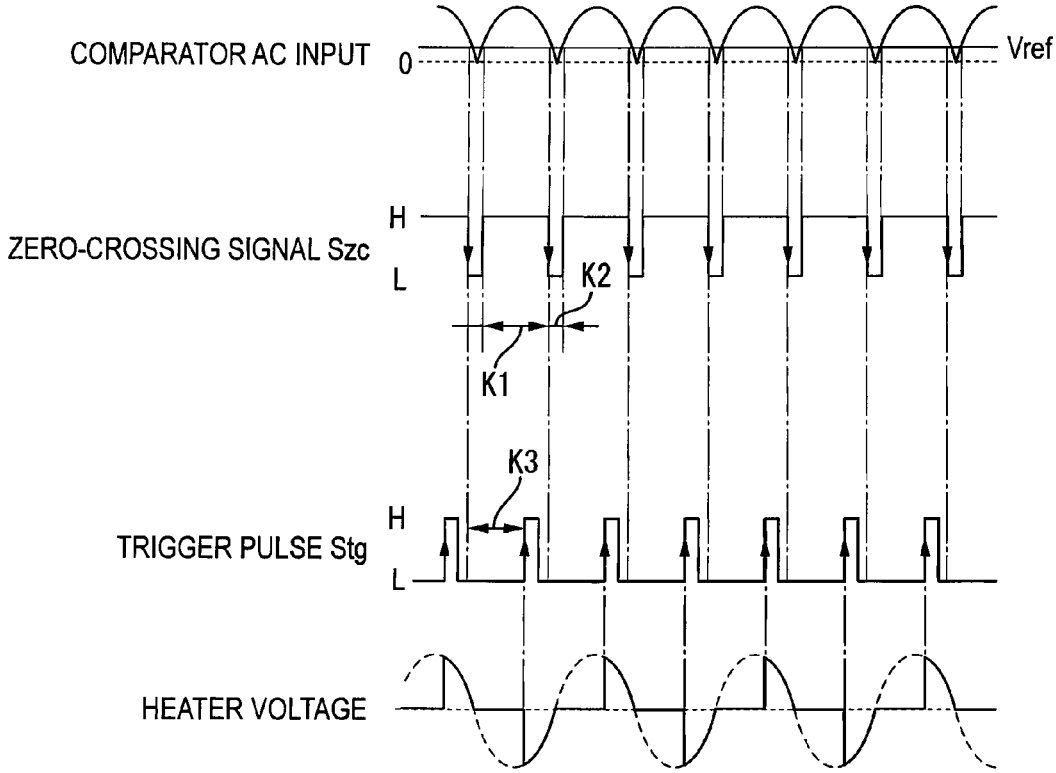
FIG. 6 is a time chart of various signals related to the heater voltage.

Next, a heating device 30 provided in the printer 1 will be described with reference to FIGS. 2 to 4 and FIG. 6. FIG. 2 is a block diagram showing a schematic configuration of the heating device 30. FIG. 3 is a block diagram showing a schematic configuration of a zero-crossing detecting circuit of the heating device 30. FIG. 4 is a block diagram showing a schematic configuration of a fixing driver circuit of the heating device 30. FIG. 6 is a typical time chart for explaining various signals related to generation of a heater voltage supplied to the halogen heater 33.

The heating device 30 includes a low-voltage power supply circuit (AC-DC converter) 31, a fixing relay (an example of "switching unit") 32, the halogen heater 33, an ASIC (application-specific integrated circuit) 34, a zero-crossing detecting circuit (corresponding to "zero-crossing signal generating circuit) 40, a fixing driver circuit (an example of an "energization regulating unit") 50, and the like. In Embodiment 1, as shown in FIG. 2, an alternating-current power supply AC is supplied from in front of the fixing relay 32 to the low-voltage power supply circuit 31 and the zero-crossing detecting circuit 40. It should be noted that the low-voltage power supply circuit 31 and the fixing relay 32 need not be included in the heating device 30.

The low-voltage power supply circuit 31 converts an AC voltage of 100 V, for example, to DC voltages of 24 V and 3.3 V and supplies the DC voltages to respective portions. The halogen heater 33 generates heat in response to energization of the alternating-current power supply AC.

The zero-crossing detecting circuit 40 generates a zero-crossing signal Szc in synchronization with a zero-crossing time of the alternating-current power supply AC. Specifically, as shown in FIG. 3, the zero-crossing detecting circuit 40 includes a full-wave rectification bridge 41, voltage-dividing resistors R1 and R2, a reference voltage (corresponding to "reference voltage value") Vref, a comparator 42, a drive transistor 43, a photo-coupler 44, and the like.

The voltage of the alternating-current power supply AC converted to only the positive voltage side by the full-wave rectification bridge 41 is decreased by the voltage-dividing resistors R1 and R2, and the decreased voltage of the alternating-current power supply AC is compared with the reference voltage Vref by the comparator 42. Here, the reference voltage Vref is set so that a zero-crossing signal Szc having a pulse width (signal width) corresponding to a predetermined period is obtained. In this example, when the decreased voltage of the alternating-current power supply AC exceeds the reference voltage Vref, that is, when the alternating-current power supply AC is not in a period near its zero-crossing point, the output of the comparator 42 becomes LOW. At that time, the drive transistor 43 is turned off, and the photo-coupler 44 is not driven, whereby a zero-crossing signal Szc of a high level is generated (see period K1 in FIG. 6).

For example, the reference voltage Vref can be set to Vref≈6.3 (V) as below.

$$v = Vm(R2/(R1+R2))\sin \omega t$$

In this equation, v is the voltage of the alternating-current power supply AC, Vm is the highest voltage of the alternating-current power supply AC, R1 and R2 are the resistance values of the voltage-dividing resistors R1 and R2, and $\omega=2\pi f$. For example, if $R2/(R1+R2)=1/10$, $Vm=132*\sqrt{2}$(V), t=0.45 msec, Vf (voltage drop of a rectification diode)=0.7 (V), and f (frequency)=60 Hz, $Vref=((132*\sqrt{2}-0.7*2)/10)*\sin(2\pi*60*0.45*10^{-3})\approx 6.3$ (V).

Here, time t (0.45 msec) is set to a predetermined period in which it is possible to detect a zero-crossing point of a typical alternating-current power supply AC (f=60 Hz), and which corresponds to ½ of period K2 shown in FIG. 6.

On the other hand, when the decreased voltage of the alternating-current power supply AC is equal to or smaller than the reference voltage Vref, that is, when the alternating-current power supply AC is in a period near its zero-crossing point, the output of the comparator 42 becomes HIGH. At that time, the drive transistor 43 is turned on, and the photo-coupler 44 is driven, whereby a zero-crossing signal Szc of a low level is generated (see period K2 in FIG. 6). In this embodiment, a low-level period K2 of the zero-crossing signal Szc corresponds to "signal width."

The fixing driver circuit 50 regulates the energization period of the alternating-current power supply AC, based on the zero-crossing signal Szc. Specifically, as shown in FIG. 4, the fixing driver circuit 50 includes a TRIAC 52, a photo-TRIAC coupler 53, a drive transistor 54, and the like. The photo-TRIAC coupler 53 is turned on by the drive transistor 54 in response to a trigger signal Stg generated based on the falling edge of the zero-crossing signal Szc. In response to the turn-on of the photo-TRIAC coupler 53, the TRIAC 52 is turned on, and the halogen heater 33 is energized by the alternating-current power supply AC for a predetermined energization period. The predetermined energization period is a period occurring from a rising time of the trigger signal Stg to the zero-crossing time of the alternating-current power supply AC (see FIG. 6). That is, by changing period K3 (see FIG. 6) occurring from the falling time of the zero-crossing signal Szc to the rising time of the trigger signal Stg, the temperature of the fixing unit 7 is controlled by the halogen heater 33.

The fixing relay 32 is provided between the alternating-current power supply AC and the halogen heater 33 so as to switch on and off the connection between the alternating-current power supply AC and the halogen heater 33. It should be noted that the switching unit is not limited to the relay, and the switching unit may be configured, for example, by a semiconductor element.

The ASIC (an example of a "voltage change rate detecting unit," "energization disabling unit," and "enabling unit") 34 includes an interface circuit 35, a counter 36, a memory 37, and the like and controls the energization of the fixing unit 7. The interface circuit 35 mediates the exchange of various data with external devices connected to the ASIC 34. The counter 36 is used for controlling the energization of the fixing unit 7. The memory 37 includes a ROM and a RAM.

The ASIC 34 detects whether or not the rate of voltage change of the alternating-current power supply AC at the zero-crossing time is equal to or larger than a predetermined value (allowable value). When the rate of voltage change (hereinafter referred to as "dv/dt") is equal to or larger than the predetermined value, the ASIC 34 disables the energization of the halogen heater 33 by the alternating-current power supply AC by switching off (controlling) the relay 32.

In Embodiment 1, the ASIC 34 makes the determination as to whether or not the dv/dt of the alternating-current power supply AC at the zero-crossing time is equal to or larger than the predetermined value by detecting whether or not the zero-crossing pulse width (corresponding to "signal width") K2 of the zero-crossing signal Szc is equal to or smaller than a predetermined period. However, without being limited to this, the determination as to whether or not the dv/dt of the alternating-current power supply AC at the zero-crossing time is equal to or larger than the predetermined value may be made, for example, by sampling and obtaining the waveform of the alternating-current power supply AC near the zero-crossing time and making the determination from the waveform itself of the alternating-current power supply AC.

Moreover, the ASIC 34 is connected to the image forming unit 6 and the photo data importing unit 26 so as to perform various processes related to image formation in addition to energization control of the fixing unit 7.

3. Energization Control of Fixing Unit

Figure 5:
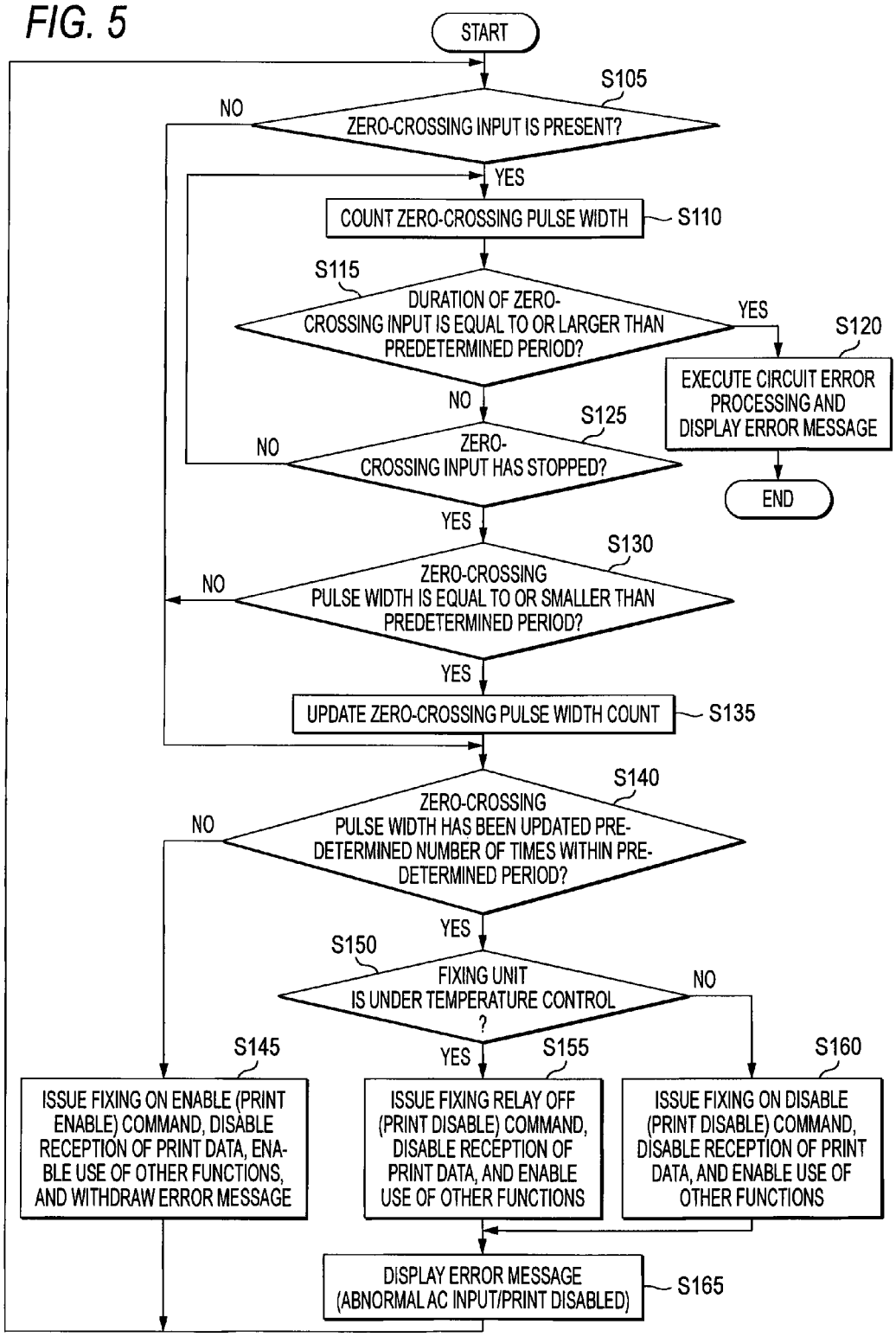
FIG. 5 is a flowchart of an energization control process of a fixing unit according to Embodiment 1.
Figure 7:
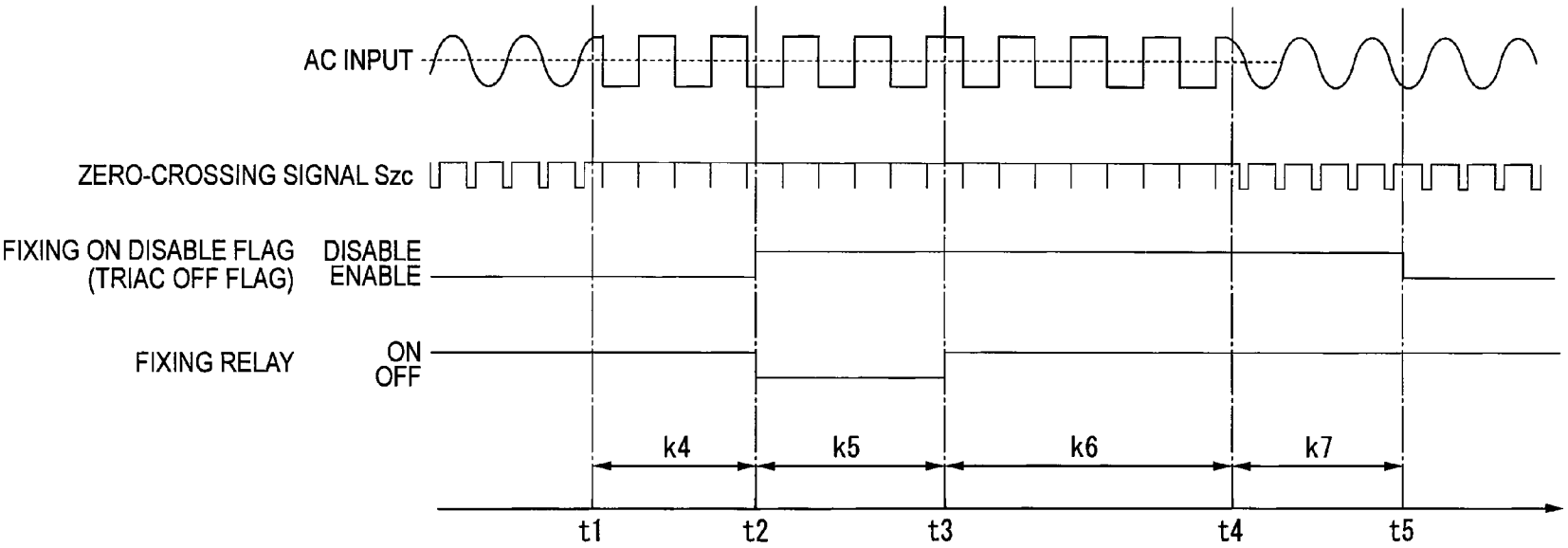
FIG. 7 is a time chart of signals related to the energization control process.

Next, energization control of the fixing unit 7 in Embodiment 1 will be described with reference to FIGS. 5 and 7. FIG. 5 is a flowchart schematically showing the flow of various processes related to energization control of the fixing unit 7, and FIG. 7 is a schematic time chart of signals related to the energization control of the fixing unit 7. The energization control process of the fixing unit 7 is performed by the ASIC 34 in accordance with a predetermined program, for example, when the printer 1 is powered on.

In step S105 of FIG. 5, the ASIC 34 determines whether or not there is a zero-crossing input. That is, it is determined whether or not there is a period (pulse width K2) where the zero-crossing signal Szc becomes LOW. When it is determined that there is no zero-crossing input (S105: NO), the flow proceeds to step S140. This determination process of step S105 is provided in order to make sure that a case where a DC (direct-current) is input to the fixing unit 7 is also detected.

On the other hand, when it is determined that there is a zero-crossing input (S105: YES), namely, when it is determined that the input to the fixing unit 7 is not DC, an operation of counting the zero-crossing pulse width K2 of the zero-crossing signal Szc is started in step S110.

Subsequently, it is determined in step S115 whether the duration of the zero-crossing input is equal to or larger than a predetermined period Kzc1, that is, whether or not the count value of the zero-crossing pulse width. K2 has reached the first predetermined period Kzc1 or more. Here, the first predetermined period Kzc1 is set to a value larger than the half cycle of the alternating-current power supply AC. If the frequency of the alternating-current power supply AC is 60 Hz, the first predetermined period Kzc1 is 9.0 msec, for example.

When it is determined that the count value of the zero-crossing pulse width K2 has reached a predetermined period (S115: YES), the ASIC 34 displays an error message on the display device 27 of the printer 1, for example, in step S120 by determining that some abnormalities have occurred in a circuit or the like that drives the halogen heater 33. Then, the energization control process ends. That is, the energization of the halogen heater 33 is generally controlled so that the zero-crossing pulse width K2 is equal to or smaller than the half cycle of the alternating-current power supply AC. Therefore, when the zero-crossing pulse width K2 exceeds the half cycle of the alternating-current power supply AC, it is determined that some abnormalities, for example, in the power supply have occurred.

On the other hand, when it is determined that the count value of the zero-crossing pulse width K2 has not reached the predetermined period (first predetermined period Kzc1) (S115: NO), the flow proceeds to step S125, and the ASIC 34 determines whether or not the zero-crossing input has stopped. When it is determined that the zero-crossing input has not stopped (S125: NO), the flow returns to step S110. On the other hand, when it is determined that the zero-crossing input has stopped (S125: YES), it is determined in step S130 whether or not the zero-crossing pulse width K2 is equal to or smaller than a second predetermined period Kzc2. Here, the second predetermined period Kzc2 is set to a value such that, even when a voltage of which the dv/dt at the zero-crossing time is equal to or larger than the predetermined value is applied to the TRIAC 52, the TRIAC 52 does not cause malfunctioning. The second predetermined period Kzc2 is set to 0.1 msec, for example. More specifically, the second predetermined period Kzc2 is determined in advance through tests or the like based on the electrical characteristics of the TRIAC 52 being used, the reference voltage Vref of the comparator 42 that determines the zero-crossing pulse width K2, and the like.

It should be noted that the present invention is not limited to an example where the second predetermined period Kzc2 has only one value which is 0.1 msec, for example. The second predetermined period Kzc2 may have a plurality of different values, and different waveform abnormalities in the alternating-current power supply AC are detected in accordance with the value of the second predetermined period Kzc2. For example, it will be assumed that the second predetermined period Kzc2 is set to have two values 0.1 msec and 0.67 msec. When the zero-crossing pulse width K2 is equal to or smaller than 0.67 msec, it is detected that the alternating-current power supply AC has a sinusoidal waveform of which the amplitude is very large. When the zero-crossing pulse width K2 is equal to or smaller than 0.1 msec, it is detected that the alternating-current power supply AC has an approximately rectangular waveform. Here, the values of the second predetermined period Kzc2 can be converted into dv/dt values, and a period of 0.1 msec corresponds to 0.6 V/μsec in terms of dv/dt values.

When it is determined that the zero-crossing pulse width K2 is not equal to or smaller than the second predetermined period Kzc2 (S130: NO), the flow proceeds to S140. When it is determined that the zero-crossing pulse width K2 is equal to or smaller than the second predetermined period Kzc2 (S130: YES), the number of occurrences of an event where it is determined that the zero-crossing pulse width K2 is equal to or smaller than the second predetermined period Kzc2 is updated in step S135. That is, the number of occurrences is incremented.

Subsequently, the ASIC 34 determines whether or not the zero-crossing pulse width K2 has been updated a predetermined number of times within a predetermined period. That is, the ASIC 34 determines whether or not the number of occurrences of an event where it is determined that the zero-crossing pulse width K2 is equal to or smaller than the second predetermined period Kzc2 has reached a predetermined number of times within a predetermined period. Here, the predetermined period is set to period K4 occurring from time t1 to time t2 shown in FIG. 7 and the predetermined number of times is set to 5 times, for example, as shown in FIG. 7. The determining process of step S140 is provided in order to suppress erroneous energization control from being performed when the zero-crossing pulse width K2 has become equal to or smaller than the second predetermined period Kzc2 due to noise or the like. That is, the predetermined period K4 and the predetermined number of times are determined in advance through tests or the like as conditions for preventing problems in the fixing unit 7, and if the fixing relay 32 is not provided, as conditions for guaranteeing the normal operation of the TRIAC 52.

When it is determined that the zero-crossing pulse width K2 has not been updated the predetermined number of times within the predetermined period K4 (S140: NO), the ASIC 34 issues a Fixing ON Enable (Print Enable) command in step S145. Specifically, a fixing ON Disable flag shown in FIG. 7 is maintained to be LOW. Moreover, the ASIC 34 disables reception of print data, enables the use of functions other than a print function, and withdraws an error message, and the flow returns to step S105.

On the other hand, when it is determined that the zero-crossing pulse width K2 has been updated the predetermined number of times within the predetermined period K4 (S140: YES), it is determined in step S150 whether or not the fixing unit 7 is presently being subjected to temperature control, that is, whether or not the energization of the halogen heater 33 is presently being controlled. When it is determined that the fixing unit 7 is being subjected to temperature control (S150: YES, corresponding to time t2 in FIG. 7), the ASIC 34 disables a print operation by turning off the fixing relay 32 and changing the level of the Fixing ON Disable flag from LOW to HIGH in step S155. Moreover, the ASIC 34 disables reception of print data and enables the use of functions other than the print function. As the functions other than the print function, for example, a function of importing image data through the photo data importing unit 26 is enabled.

That is to say, when the number of occurrences of an event where it is determined that the zero-crossing pulse width K2 is equal to or smaller than the second predetermined period Kzc2 has reached a predetermined number of times (in this example, 5 times) within the predetermined period K4, it is determined that a voltage of which the dv/dt at the zero-crossing time is equal to or larger than the predetermined value is applied to the TRIAC 52. Therefore, by disabling the energization of the halogen heater 33, the occurrence of problems in the fixing unit 7 due to a rectangular-wave voltage input to the printer 1 can be suppressed.

On the other hand, when it is determined that the fixing unit 7 is not being subjected to temperature control (S150: NO), the ASIC 34 disables turning-ON of the fixing unit 7 and disables a print operation in step S160. Moreover, the ASIC 34 disables transmission of print data and enables the use of the functions other than the print function. That is, when it is detected that dv/dt (rate of voltage change) at the zero-crossing time is equal to or larger than the predetermined value before the halogen heater 33 is energized, the ASIC 34 disables the energization of the halogen heater 33 by the alternating-current power supply AC by causing the fixing driver circuit 50 to not start an operation of regulating the energization period.

Subsequently, in step S165, the ASIC 34 displays an error message, for example, "Abnormal AC Input/PRINT Disabled," on the display device 27 of the printer 1. Then, the flow returns to step S105.

In FIG. 7, period K5 occurring from time t2 to time t3 is a Relay Forced OFF period where the fixing relay 32 is forcibly switched off. Moreover, period K6 is a period where TRIAC ON Disable is continued since, similarly to the period K4, the zero-crossing pulse width K2 within a predetermined period is detected a predetermined number of times within a predetermined period. Here, the reason for switching on the fixing relay 32 at time t3 is to make sure that the zero-crossing can be detected even when the zero-crossing detecting circuit is provided at the rear stage of the fixing relay 32 (see FIG. 8). In this case, even when the fixing relay 32 is switched on, the supply of current to the fixing unit 7 is disabled until time t5.

4. Advantage of Embodiment 1

When the rate of voltage change dv/dt of the alternating-current power supply AC at the zero-crossing time is equal to or larger than the predetermined value, it is possible to determine that the rate of change dv/dt of the voltage of the alternating-current power supply AC input to the heating device 30 is larger than the rate of change in a sinusoidal wave which is the waveform of a typical commercial power supply. Thus, by appropriately setting the predetermined value of the rate of voltage change dv/dt, it is possible to determine that a rectangular wave of which the rate of voltage change dv/dt at the zero-crossing time is larger than the sinusoidal wave is input to the heating device 30. Thus, it is possible to suppress the occurrence of problems in the heating device 30 due to the input rectangular wave. Here, "zero-crossing time" does not mean only the time at which the voltage of the alternating-current power supply becomes zero but includes periods occurring before and after the time at which the voltage of the alternating-current power supply becomes zero.

The zero-crossing signal Szc has the zero-crossing pulse width (signal width) K2 which is based on a comparison between the voltage value of the alternating-current power supply AC and the reference voltage value Vref. The ASIC (voltage change rate detecting unit) 34 detects whether or not the rate of voltage change dv/dt of the alternating-current power supply AC is equal to or larger than the predetermined value by detecting whether or not the zero-crossing pulse width K2 of the zero-crossing signal Szc is equal to or smaller than the predetermined period. Therefore, it is possible to appropriately detect whether or not the rate of voltage change dv/dt of the alternating-current power supply AC is equal to or larger than the predetermined value without the need for detecting the rate of voltage change dv/dt directly from the waveform of the alternating-current power supply AC.

Embodiment 2

Figure 8:
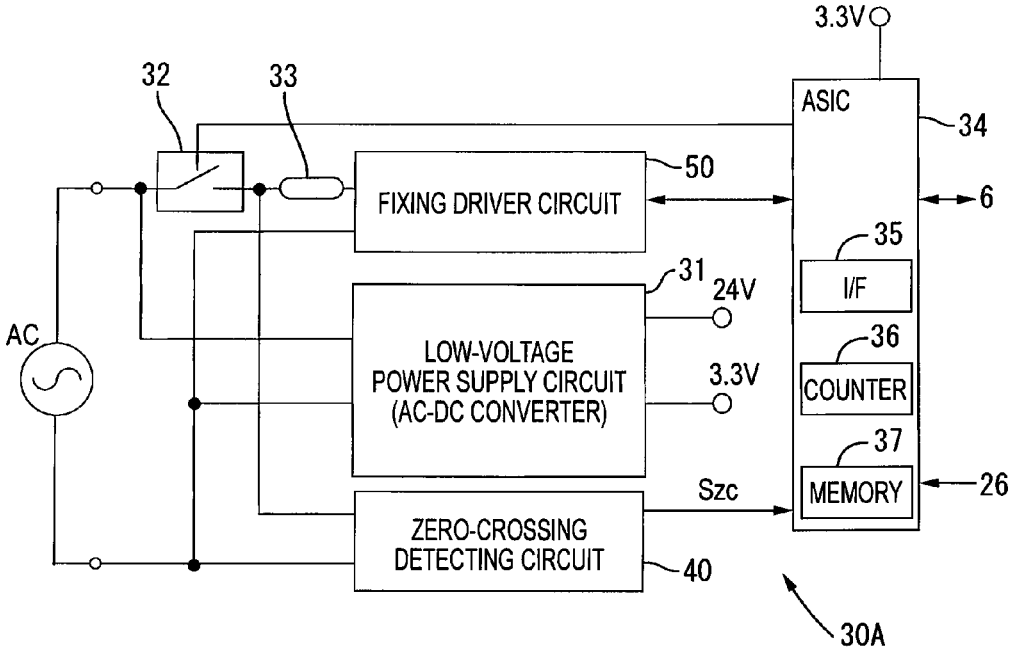
FIG. 8 is a block diagram showing a schematic configuration of a heating device of Embodiment 2.
Figure 9:
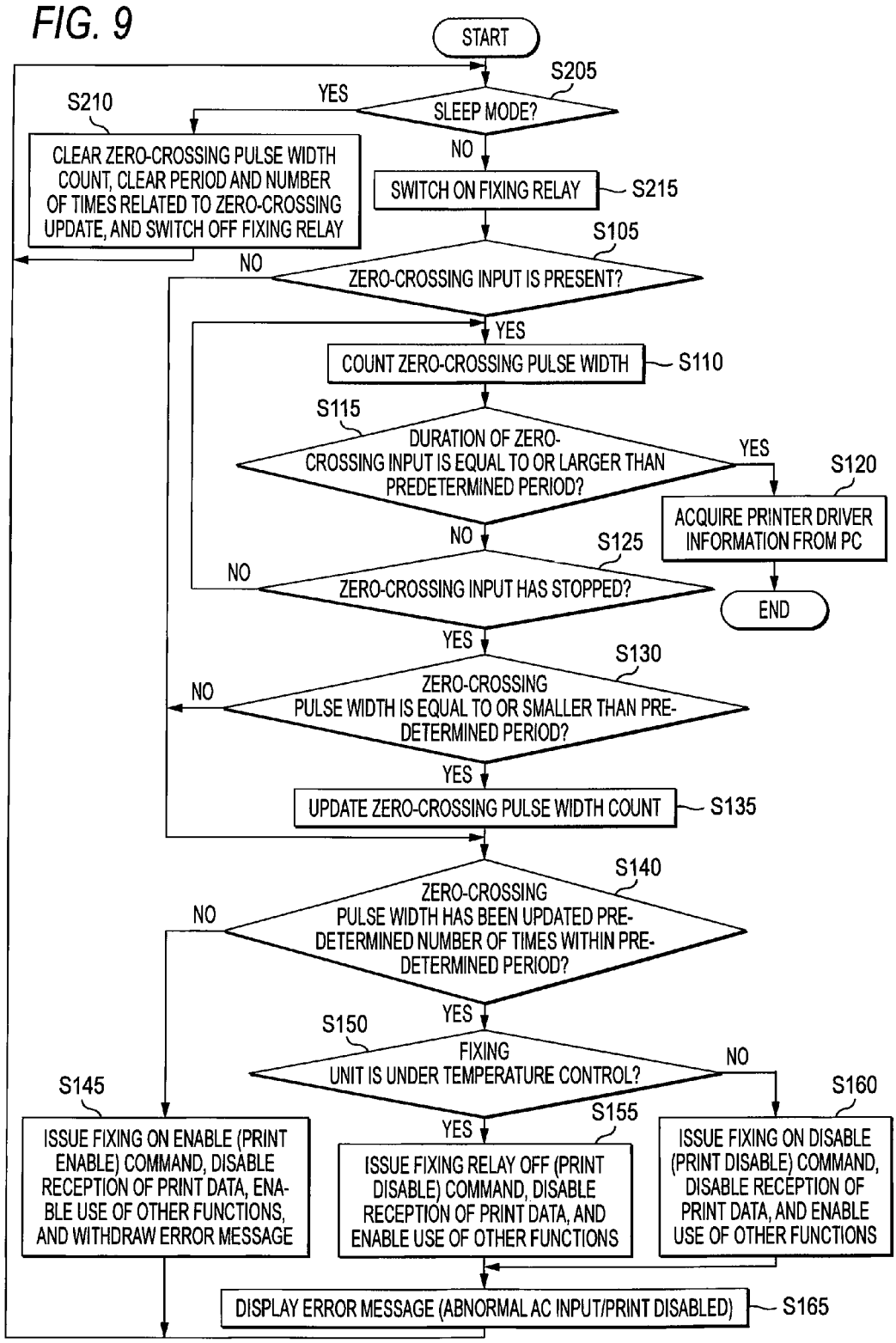
FIG. 9 is a flowchart of an energization control process of a fixing unit according to Embodiment 2.

Next, a heating device 30A according to Embodiment 2 of the present invention will be described with reference to FIGS. 8 and 9. FIG. 8 is a block diagram showing a schematic configuration of the heating device 30A, and FIG. 9 is a flowchart schematically showing the flow of various processes related to energization control of the fixing unit 7 of Embodiment 2. In FIG. 9, the same processes as the processes of Embodiment 1 shown in FIG. 5 will be denoted by the same step numbers, and description thereof will be omitted. Moreover, similarly to Embodiment 1, an energization control process of Embodiment 2 is performed by the ASIC 34 in accordance with a predetermined program, for example, when the printer 1 is powered on. Furthermore, similarly to Embodiment 1, the heating device 30A is provided in the printer 1.

Only points different from those of Embodiment 1 will be described. In Embodiment 2, as shown in FIG. 8, the alternating-current power supply AC of the zero-crossing detecting circuit 40 is taken from a node between the fixing relay 32 and the halogen heater 33. That is, unless the fixing roller 32 is turned on, the alternating-current power supply AC is not supplied to the zero-crossing detecting circuit 40.

Moreover, as an operation mode, the printer 1 has a sleep mode where the halogen heater 33 is not energized. Therefore, the ASIC (voltage change rate detecting unit) 34 does not detect whether or not the dv/dt of the alternating-current power supply AC at the zero-crossing time is equal to or larger than the predetermined value during the sleep mode of the printer 1.

That is, when the printer 1 is powered on, first, in step S205 of FIG. 9, the ASIC 34 determines whether or not the printer 1 is presently in the sleep mode. When it is determined that the printer 1 is presently in the sleep mode (S205: YES), the ASIC 34 clears respective count values (counters) in step S210 since the determination as to whether or not dv/dt of the alternating-current power supply AC at the zero-crossing time is equal to or larger than the predetermined value is not performed. That is, the count value of the zero-crossing pulse width (K2), the count values of the predetermined period (K4) related to zero-crossing updating, and the count value of the predetermined number of times related to zero-crossing updating are cleared. Moreover, the fixing relay 32 is switched off, and the flow returns to step S205.

On the other hand, when it is determined that the printer 1 is presently not in the sleep mode (S205: NO), the ASIC 34 switches on the fixing relay 32 in step S215. After that, the ASIC 34 performs the processes of steps S105 to S165 similarly to Embodiment 1.

5. Advantage of Embodiment 2

Since the fixing relay 32 is not switched on during the sleep mode, the alternating-current power supply AC is not supplied to the zero-crossing detecting circuit 40. Therefore, it is possible to save power consumed by the heating device 30A and hence the printer 1 during the sleep mode.

Other Embodiments

The present invention is not limited to the embodiments described above and illustrated in the drawings, and for example, the following embodiments are also included in the technical scope of the present invention.

(1) Although the above-described embodiments have described an example where the present invention is applied to a printer as an image forming apparatus, the image forming apparatus may be a so-called multi-function printer including a scanner unit (reading unit) that reads a document. In this case, the ASIC (enabling unit) 34 may enable the use of the scanner unit during a period when the energization of the halogen heater 33 is disabled (see step S145 of FIG. 5).

(2) Although the above-described embodiments have described an example where the fixing relay (switching unit) 32 is provided at the front stage of the halogen heater 33 and between the alternating-current power supply AC and the halogen heater 33, the fixing relay 32 may be omitted. In this configuration, when it is detected that the rate of voltage change is equal to or larger than the predetermined value before the halogen heater 33 is energized, it is possible to disable the energization of the halogen heater 33 by the alternating-current power supply AC by causing the fixing driver circuit (energization regulating unit) 50 to start the operation of regulating the energization period. Therefore, when the input of a rectangular alternating-current power supply AC is detected before the halogen heater 33 is energized, it is at least possible to appropriately suppress the occurrence of problems in the heating device 30 due to the input rectangular alternating-current power supply AC.

(3) Although the above-described embodiments and the other embodiment (2) described above have described an example where the ASIC (energization disabling unit) 34 disables the energization of the halogen heater 33 when an event where the rate of voltage change is equal to or larger than the predetermined value, that is, where the zero-crossing pulse width K2 is equal to or smaller than the predetermined period, is detected the predetermined number of times within the predetermined period, the present invention is not limited to this. For example, the ASIC 34 may disable the energization of the halogen heater 33 simply when the event where the rate of voltage change is equal to or larger than the predetermined value, that is, where the zero-crossing pulse width K2 is equal to or smaller than the predetermined period, is detected a plurality of times. Alternatively, the ASIC 34 may disable the energization of the halogen heater 33 simply when the event where the rate of voltage change is equal to or larger than the predetermined value, that is, where the zero-crossing pulse width K2 is equal to or smaller than the predetermined period, is detected a predetermined consecutive number of times. Here, the predetermined number of times can be determined in advance through tests or the like under the same conditions as the above-described embodiments.

In such a case, even when the event where the signal width is equal to or smaller than the predetermined period is erroneously detected due to the influence of noise or the like, by performing the detection a plurality of times and suppressing the disabling of the energization based on the erroneous detection, it is possible to determine more accurately whether or not a rectangular wave is input.

(4) Although the above-described embodiments and the other embodiments described above have described an example where the ASIC (releasing unit) 34 may release the disabled energization when the event where the rate of voltage change is equal to or larger than the predetermined value (where the zero-crossing pulse width K2 is equal to or smaller than the predetermined period) is not detected within the predetermined period after the energization of the heat generating unit is disabled. In this case, the ASIC (releasing unit) 34 may enable TRIAC ON after time t5 when the zero-crossing pulse width K2 of equal to or larger than the predetermined period is detected a predetermined number of times (5 times in FIG. 7) within period K7 occurring from time t4 to time t5 as shown in FIG. 7. In this case, the predetermined period and the predetermined number of times are determined in advance through tests or the like as conditions for guaranteeing the normal operation of the alternating-current power supply AC.

Furthermore, the ASIC (release disabling unit) 34 may disable the releasing unit from releasing the disabled energization when the number of times the ASIC (energization disabling unit) 34 disables the energization reaches a predetermined number of times. In this case, when the switching unit is configured, for example, by a relay circuit, it is possible to prevent the occurrence of problems in the relay circuit and the thermal runaway of the heat generating unit, which may occur when the relay circuit is frequently switched on and off.

According to the first aspect of the exemplary embodiments, there is provided a heating device comprising: a heat generating unit that generates heat in response to energization of an alternating-current power supply; a zero-crossing signal generating circuit that generates a zero-crossing signal in synchronization with a zero-crossing time of the alternating-current power supply; an energization regulating unit that regulates an energization period of the heat generating unit by the alternating-current power supply based on the zero-crossing signal; a voltage change rate detecting unit that detects whether or not a rate of voltage change of the alternating-current power supply at the zero-crossing time is equal to or larger than an predetermined value; a switching unit that is provided between the alternating-current power supply and the heat generating unit, the switching unit switching on and off a connection between the alternating-current power supply and the heat generating unit; and an energization disabling unit that disables energization of the heat generating unit by the alternating-current power supply by controlling the switching unit when the rate of voltage change is equal to or larger than the predetermined value.

According to this configuration, when the rate of voltage change of the alternating-current power supply at the zero-crossing time is equal to or larger than the predetermined value, it is possible to determine that the rate of voltage change at the zero-crossing time of the alternating-current power supply is larger than the rate of change in a sinusoidal wave which is the waveform of a typical commercial power supply. Thus, by appropriately setting the predetermined value of the rate of voltage change, it is possible to determine that a rectangular wave, of which the rate of change at the zero-crossing time is larger than the sinusoidal wave, is input into the heating device. Thus, it is possible to suppress the occurrence of problems in the heating device due to the input rectangular wave. Here, "zero-crossing time" does not mean only the time at which the voltage of the alternating-current power supply becomes zero, but includes periods occurring before and after the time at which the voltage of the alternating-current power supply becomes zero.

According to the second aspect of the exemplary embodiments, in addition to the first aspect, wherein when it is detected that the rate of voltage change is equal to or larger than the predetermined value before the heat generating unit is energized, the energization disabling unit disables energization of the heat generating unit by disabling the energization regulating unit from starting an operation of regulating the energization period, and wherein when it is detected that the rate of voltage change is equal to or larger than the predetermined value after the heat generating unit is energized, the energization disabling unit disables energization of the heat generating unit by switching the switching unit from an ON state to an OFF state.

According to this configuration, it is possible to appropriately disable energization of the heat generating unit before and after the heat generating unit is energized. Moreover, for example, in a configuration in which the voltage detection of the zero-crossing signal generating circuit is performed between the switching unit and the heat generating unit, when a rectangular wave is input before the heat generating unit is energized, the energization of the heat generating unit is disabled by the energization disabling unit in the ON state of the switching unit. Thus, when the power supply returns to a normal state before the heat generating unit is energized, it is possible to start energizing the heat generating unit by only causing the energization regulating unit to simply regulate the energization period without the need for controlling the switching of the switching unit. That is, it is possible to shorten an energization start time when the disabled energization is released before the heat generating unit is energized.

According to the third aspect of the exemplary embodiments, in addition to the first aspect, wherein when it is detected that the rate of voltage change is equal to or larger than the predetermined value before the heat generating unit is energized, the energization disabling unit disables energization of the heat generating unit by maintaining the switching unit to be in an OFF state, and wherein when it is detected that the rate of voltage change is equal to or larger than the predetermined value after the heat generating unit is energized, the energization disabling unit disables energization of the heat generating unit by switching the switching unit from an ON state to an OFF state.

According to this configuration, it is possible to appropriately disable energization of the heat generating unit before and after the heat generating unit is energized. Moreover, when for example, a TRIAC is used as the energization regulating unit, if a voltage such as a rectangular voltage, of which the rate of voltage change at the zero-crossing time is large, is applied, the TRIAC is turned on, and thus it is not possible to realize an OFF state. However, by switching off the switching unit to cut the connection between the power supply and the heat generating unit, it is possible to reliably disable the energization of the heat generating unit and to suppress the occurrence of problems in the heating device due to the input rectangular wave.

According to the fourth aspect of the exemplary embodiments, in addition to anyone of the first aspect to the third aspect, wherein the energization disabling unit disables energization of the heat generating unit when an event that the rate of voltage change is equal to or larger than the predetermined value is detected a plurality of times.

According to this configuration, even when the event that the rate of voltage change is equal to or larger than the predetermined value is erroneously detected due to the influence of noise or the like, it is possible to determine more accurately whether or not a rectangular wave is input by suppressing the disabling of the energization based on the erroneous detection.

According to the fifth aspect of the exemplary embodiments, in addition to the fourth aspect, wherein the energization disabling unit disables energization of the heat generating unit when the event that the rate of voltage change is equal to or larger than the predetermined value is detected a predetermined number of times within a predetermined period.

According to the sixth aspect of the exemplary embodiments, in addition to the fourth aspect, wherein the energization disabling unit disables energization of the heat generating unit when the event that the rate of voltage change is equal to or larger than the predetermined value is detected a predetermined consecutive number of times.

According to the configurations of the fifth and sixth aspects, it is possible to determine more accurately whether or not a rectangular wave is input.

According to the seventh aspect of the exemplary embodiments, in addition to anyone of the first aspect to the sixth aspect, further comprising, a releasing unit that releases the disabled energization when an event that the rate of voltage change is equal to or larger than the predetermined value is not detected within a predetermined period after energization of the heat generating unit is disabled.

According to this configuration, it is possible to improve usability and suppress problems in the heating device.

According to the eighth aspect of the exemplary embodiments, in addition to the seventh aspect, the heat device further comprises a release disabling unit that disables the releasing unit from releasing the disabled energization when the number of times the energization disabling unit disables the energization reaches a predetermined number of times.

According to this configuration, when the switching unit is configured, for example, by a relay circuit, it is possible to prevent the occurrence of problems in the relay circuit and the thermal runaway of the heat generating unit, which may occur when the relay circuit is frequently switched on and off.

According to the ninth aspect of the exemplary embodiments, there is provided a heating device comprising: a heat generating unit that generates heat in response to energization of an alternating-current power supply; a zero-crossing signal generating circuit that generates a zero-crossing signal in synchronization with a zero-crossing time of the alternating-current power supply; an energization regulating unit that regulates an energization period of the heat generating unit by the alternating-current power supply based on the zero-crossing signal; a voltage change rate detecting unit that detects whether or not a rate of voltage change of the alternating-current power supply at the zero-crossing time is equal to or larger than an predetermined value; and an energization disabling unit that disables energization of the heat generating unit via the alternating-current power supply by disabling the energization regulating unit from starting an operation of regulating the energization period when it is detected that the rate of voltage change is equal to or larger than the predetermined value before the heat generating unit is energized.

According to this configuration, when the rate of voltage change in the alternating-current power supply at the zero-crossing time is equal to or larger than the predetermined value before the heat generating unit is energized, it is possible to determine that the rate of voltage change at the zero-crossing time of the alternating-current power supply is larger than the rate of change in a sinusoidal wave which is the waveform of a typical commercial power supply. Thus, by appropriately setting the predetermined value of the rate of voltage change, it is possible to determine that a rectangular wave, of which the rate of change at the zero-crossing time is larger than the sinusoidal wave, has been input to the heating device. As a result, it is possible to disable the operation of the energization regulating unit before the heat generating unit is energized and to suppress the occurrence of problems in the heating device due to the input rectangular wave. Here, "zero-crossing time" does not mean only the time at which the voltage of the alternating-current power supply becomes zero, but includes periods occurring before and after the time at which the voltage of the alternating-current power supply becomes zero.

According to the tenth aspect of the exemplary embodiments, in addition to anyone of the first aspect to the ninth aspect, wherein the zero-crossing signal has a signal width based on a comparison between a voltage value of the alternating-current power supply and a reference voltage value, and wherein the voltage change rate detecting unit detects whether or not the rate of voltage change of the alternating-current power supply is equal to or larger than the predetermined value by determining whether or not the signal width of the zero-crossing signal is equal to or smaller than a predetermined period.

According to this configuration, the determination as to whether or not the rate of voltage change of the alternating-current power supply is equal to or larger than the predetermined value can be appropriately made by detecting whether or not the signal width of the zero-crossing signal is equal to or smaller than the predetermined period.

According to the eleventh aspect of the exemplary embodiments, in addition to anyone of the first aspect to the tenth aspect, wherein the energization regulating unit is a TRIAC.

Although a TRIAC is generally used as the energization regulating (heating control) unit of the heat generating unit, the TRIAC device has such a characteristic that the TRIAC is in a state of conduction at the zero-crossing time and does not shift to the non-conduction state at the zero-crossing time if the rate of change (dv/dt) of the power supply voltage at the zero-crossing time becomes equal to or larger than an predetermined value. However, even when a power supply voltage, such as a rectangular wave, of which dv/dt is large, is applied to the heating device, by causing the energization disabling unit to switch off the switching unit (for example, a relay circuit), energization of the heat generating unit by the rectangular alternating-current power supply is disabled. Thus, even when the energization of the heat generating unit is controlled using a TRIAC, it is possible to appropriately suppress the occurrence of problems in the heating device due to the input rectangular wave.

According to the twelfth aspect of the exemplary embodiments, there is provided an image forming apparatus comprising: the heating device according to anyone of the first aspect to the eleventh aspect; an image forming unit that forms images fixed to a recording medium by the heating device on the recording medium in accordance with image data; a reading unit that reads a document; and an enabling unit that enables the use of the reading unit when energization of the heat generating unit is disabled.

According to this configuration, by using a fixing unit which has a heating device capable of appropriately suppressing the occurrence of problems due to an input rectangular wave, it is possible to improve power supply-resistance of the fixing unit of an image forming apparatus and to thus improve the reliability of the image forming apparatus. Moreover, when the image forming apparatus is a multi-function printer, even if a printing function is temporarily disabled due to problems in the heating device, since the scanner function is still usable, it is possible to improve the usability of the image forming apparatus.

According to the thirteenth aspect of the exemplary embodiments, in addition to the twelfth aspect, wherein the image forming apparatus has a sleep mode where the heat generating unit is not energized, and wherein during the sleep mode, the voltage change rate detecting unit does not detect whether or not the rate of voltage change of the alternating-current power supply at the zero-crossing time is equal to or larger than the predetermined value.

According to this configuration, since no unnecessary detecting operation is performed, it is possible to reduce power consumption.

According to the present invention, the occurrence of problems in the heating device due to the input rectangular wave can be appropriately suppressed.

What is claimed is:

1. A heating device comprising:

a heat generating unit that generates heat in response to energization of an alternating-current power supply;

a zero-crossing signal generating circuit that generates a zero-crossing signal in synchronization with a zero-crossing time of the alternating-current power supply;

an energization regulating unit that regulates an energization period of the heat generating unit by the alternating-current power supply based on the zero-crossing signal;

a voltage change rate detecting unit that detects whether a rate of voltage change of the alternating-current power supply at the zero-crossing time is equal to or larger than a predetermined value;

a switching unit that is provided between the alternating-current power supply and the heat generating unit, the switching unit switching on and off a connection between the alternating-current power supply and the heat generating unit; and an energization disabling unit that disables energization of the heat generating unit by the alternating-current power supply by controlling the switching unit when the rate of voltage change is equal to or larger than the predetermined value, wherein the energization regulating unit is provided downstream of the switching unit with respect to the alternating-current power supply and is connected in series with the heat generating unit, wherein when it is detected that the rate of voltage change is equal to or larger than the predetermined value before the heat generating unit is energized and when the switching unit is in an ON state, the energization disabling unit disables energization of the heat generating unit by disabling the energization regulating unit from starting an operation of regulating the energization period, wherein when it is detected that the rate of voltage change is equal to or larger than the predetermined value after the heat generating unit is energized, the energization disabling unit disables energization of the heat generating unit by switching the switching unit from the ON state to an OFF state, and wherein the alternating-current power supply of the zero-crossing signal generating circuit is taken from between the switching unit and the heat generating unit.

2. The heating device according to claim 1, wherein the energization disabling unit disables energization of the heat generating unit when an event that the rate of voltage change is equal to or larger than the predetermined value is detected a plurality of times.

3. The heating device according to claim 2, wherein the energization disabling unit disables energization of the heat generating unit when the event that the rate of voltage change is equal to or larger than the predetermined value is detected a predetermined number of times within a predetermined period.

4. The heating device according to claim 2, wherein the energization disabling unit disables energization of the heat generating unit when the event that the rate of voltage change is equal to or larger than the predetermined value is detected a predetermined consecutive number of times.

5. The heating device according to claim 1, further comprising, a releasing unit that releases the disabled energization when an event that the rate of voltage change is equal to or larger than the predetermined value is not detected within a predetermined period after energization of the heat generating unit is disabled.

6. The heating device according to claim 5, further comprising, a release disabling unit that disables the releasing unit from releasing the disabled energization when the number of times the energization disabling unit disables the energization reaches a predetermined number of times.

7. The heating device according to claim 1, wherein the zero-crossing signal has a signal width based on a comparison between a voltage value of the alternating-current power supply and a reference voltage value, and wherein the voltage change rate detecting unit detects whether the rate of voltage change of the alternating-current power supply is equal to or larger than the predetermined value by determining whether the signal width of the zero-crossing signal is equal to or smaller than a predetermined period.

8. The heating device according to claim 1, wherein the energization regulating unit is a TRIAC.

9. An image forming apparatus comprising:

the heating device according to claim 1;

an image forming unit that forms images fixed to a recording medium by the heating device on the recording medium in accordance with image data;

a reading unit that reads a document; and an enabling unit that enables the use of the reading unit when energization of the heat generating unit is disabled.

10. The image forming apparatus according to claim 9, wherein the image forming apparatus is configured to operate in a sleep mode where the heat generating unit is not energized, and wherein when operating in the sleep mode, the voltage change rate detecting unit does not detect whether the rate of voltage change of the alternating-current power supply at the zero-crossing time is equal to or larger than the predetermined value.

11. The heating device according to claim 1, wherein the energization disabling unit switches the switching unit from the ON state to the OFF state and, after a predetermined time has elapsed therefrom, switches the switching unit to the ON state while causing the energization regulating unit to maintain the disabling of the energization of the heat generating unit.

12. An image forming apparatus comprising:

a heating device including, a heat generating unit that generates heat in response to energization of an alternating-current power supply, a zero-crossing signal generating circuit that generates a zero-crossing signal in synchronization with a zero-crossing time of the alternating-current power supply, an energization regulating unit that regulates an energization period of the heat generating unit by the alternating-current power supply based on the zero-crossing signal, a voltage change rate detecting unit that detects whether a rate of voltage change of the alternating-current power supply at the zero-crossing time is equal to or larger than a predetermined value, a switching unit that is provided between the alternating-current power supply and the heat generating unit, the switching unit switching on and off a connection between the alternating-current power supply and the heat generating unit, and an energization disabling unit that disables energization of the heat generating unit by the alternating-current power supply by controlling the switching unit when the rate of voltage change is equal to or larger than the predetermined value; and an image forming unit that forms images on a recording medium in accordance with image data, the images being fixed to the recording medium by the heating device, wherein the energization regulating unit is provided downstream of the switching unit with respect to the alternating-current power supply and is connected in series with the heat generating unit, wherein when it is detected that the rate of voltage change is equal to or larger than the predetermined value before the heat generating unit is energized and when the switching unit is in an ON state, the energization disabling unit disables energization of the heat generating unit by disabling the energization regulating unit from starting an operation of regulating the energization period, wherein when it is detected that the rate of voltage change is equal to or larger than the predetermined value after the heat generating unit is energized, the energization disabling unit disables energization of the heat generating unit by switching the switching unit from the ON state to an OFF state, wherein the alternating-current power supply of the zero-crossing signal generating circuit is taken from between the switching unit and the heat generating unit, wherein the image forming apparatus is configured to operate in a sleep mode where the heat generating unit is not energized, and wherein, when operating in the sleep mode, the voltage change rate detecting unit does not detect whether the rate of voltage change of the alternating-current power supply at the zero-crossing time is equal to or larger than the predetermined value.

* * * * *